US009052078B2

(12) United States Patent
Sheng

(10) Patent No.: US 9,052,078 B2
(45) Date of Patent: Jun. 9, 2015

(54) ELECTRONIC SIMULATION CANDLE

(71) Applicant: Morgan Electronic Technology Co., Ltd., Foshan, Guangdong (CN)

(72) Inventor: Guangrun Sheng, Guangdong (CN)

(73) Assignee: MORGAN ELECTRONIC TECHNOLOGY CO., LTD., Foshan, Guangdong (CN)

( * ) Notice: Subject to any disclaimer, the term of this patent is extended or adjusted under 35 U.S.C. 154(b) by 0 days.

(21) Appl. No.: 14/245,416

(22) Filed: Apr. 4, 2014

(65) Prior Publication Data

US 2014/0218903 A1 Aug. 7, 2014

(30) Foreign Application Priority Data

Apr. 16, 2013 (CN) ..... 2013 2 0191283

(51) Int. Cl.
*F21L 4/00* (2006.01)
*F21S 10/04* (2006.01)

(52) U.S. Cl.
CPC ..... *F21S 10/04* (2013.01); *F21S 10/046* (2013.01)

(58) Field of Classification Search
CPC ..... F21S 10/04; F21S 6/001; F21S 10/046; F21W 2121/00; F21Y 2101/02
USPC ..... 362/190, 393, 392, 447, 810
See application file for complete search history.

(56) References Cited

U.S. PATENT DOCUMENTS 8,789,986 B2 * 7/2014 Li ..... 362/393

* cited by examiner

*Primary Examiner* — Anh Mai
*Assistant Examiner* — Jessica M Apenteng
(74) *Attorney, Agent, or Firm* — Jackson IPG PLLC; Demian K. Jackson

(57) ABSTRACT

An electronic simulation candle including a power supply base, a power driven device, a flame piece swinger and a light source fixation base. The power driven device is electrically connected to and disposed above the power supply base. The light source fixation base is disposed above the power driven device. The flame piece swinger is disposed between the power driven device and the light source fixed base. An upper half of the flame piece swinger extends upward from a hole provided on the base. The upper half of the flame piece swinger is a flame piece body having a concave surface. A hollow tapered swinger expanding from up to down is integrally disposed below the flame piece body. A support rod extending upward is inserted into the power driven device inserted upward into the hollow tapered swinger, with its top supporting against the inside top thereof.

18 Claims, 7 Drawing Sheets

ELECTRONIC SIMULATION CANDLE

FIELD OF THE INVENTION

The present invention relates to the technical field of decorative illumination, more particularly to an electronic simulation candle.

BACKGROUND OF THE INVENTION

To overcome defects of conventional candles, various electronic simulation candles emerge as required. With power conservation, low heat and other advantages, electronic simulation candles have gradually taken the place of conventional candles. Among the various electronic simulation candles in the market at present, there are very few electronic simulation candles, the flame of which looks more dynamic, particularly produces an effect of flickering in the wind. The degree of simulation is limited.

A similar simulation candle structure may be seen in U.S. Patents U.S. Pat. No. 8,550,660, U.S. Pat. No. 8,534,869, U.S. Pat. No. 8,342,721 and etc. That is, a permanent magnet is provided at the bottom end of a flame piece, so that a solenoid coil below the flame piece drives the flame piece to generate a swing. However, the disclosed flame piece is pivoted at an upper opening of the mechanism via a wire, so the visual aesthetics will be destroyed by the wire when viewers get close to appreciate the simulation candles. In addition, as the flame piece consists of a flexible piece body, the flame piece, without any special construction processing, just can form a swing of a single color under the coordination of an irradiation light source. As a result, the simulation effect will be greatly reduced in the case that the flame core cannot be displayed separately.

In addition, a similar simulation candle structure may also be seen in US Patent publication US2012/0134157A1. That is, a permanent magnet is also provided at the bottom end of a flame piece, so that a solenoid coil below the flame piece drives the flame piece to generate a swing. However, the disclosed flame piece is formed by allowing a support rod horizontally spanning over a central through hole to pass through the flame piece, so the visual aesthetics will be destroyed by the support rod when viewers get close to appreciate the simulation candles.

SUMMARY OF THE INVENTION

An object of the present invention is to provide an electronic simulation candle with simple structure, more visual and more realistic effect and higher degree of simulation, in order to overcome disadvantages and deficiencies in the prior art.

To achieve the above object, the present invention is implemented by the following technical solutions.

The present invention provides an electronic simulation candle, mainly comprising a power supply base, a power driven device, a flame piece swinger and a light source fixation base, the power driven device being electrically connected to the power supply base and disposed above the power supply base, the light source fixation base being disposed above the power driven device, the flame piece swinger being disposed between the power driven device and the light source fixation base, in addition, the upper half of the flame piece swinger extending upward out from a central through hole provided on the light source fixation base, wherein the upper half of the flame piece swinger is a flame piece body having a concave surface, and a hollow tapered swinger expanding gradually from up to down being integrally disposed below the flame piece body; in addition, a support rod extending upward being inserted into the power driven device, and the upper half of the support rod is able to be inserted upward into the hollow tapered swinger, with its top supporting against the inside top of the hollow tapered swinger.

In the electronic simulation candle provided by the present invention, the power supply base is an upright base having an accommodation space therein, which accommodation space can be used for accommodating batteries and then closed via a cover plate on the bottom thereof, a circuit board electrically connected to the power supply base being provided outside the power supply base, a fixed base being disposed in the top center of the power supply base.

In the electronic simulation candle provided by the present invention, the power driven device consists of a chassis which is provided with a gear set therein and sheathed on the fixed base, the gear set being electrically connected to the circuit board, an output rotating shaft of the gear set extending upward out from the top wall of the chassis and sheathed with a turntable, a driving lever protruded upward being provided on the outside of the upper surface of the turntable, a fixed column having a fixed slot being provided on the upper surface of the chassis, the fixed slot being provided for insertion and fixation of the bottom end of the support rod.

In the electronic simulation candle provided by the present invention, the support rod and the fixed column form an integrated structure.

In the electronic simulation candle provided by the present invention, on the bottom or side wall of the hollow tapered swinger, it is provided an opening for inserting the upper half of the support rod.

In the electronic simulation candle provided by the present invention, when the opening is provided on the bottom of the hollow tapered swinger, the support rod is an upright elongated rod; and, when the opening is provided on the side wall of the hollow tapered swinger, the support rod is a slender rod having an upper half bent towards the center of the power driven device first and then extending upward, so that the upper half of the support rod can be inserted upward into the hollow tapered swinger from the opening on the side wall, with the top of the support rod supporting against the inside top of the hollow tapered swinger.

In addition, in the electronic simulation candle provided by the present invention, the light source fixation base is fixed above the power driven device, a light source base obliquely passing through the central through hole upward and being fixedly provided with an irradiation light source being disposed on a side of the light source fixation base, the irradiation light source facing the concave surface of the flame piece body in addition to being electrically connected to the circuit board.

In addition, in the electronic simulation candle provided by the present invention, left and right limiting lugs are provided on an outside bottom edge of the hollow tapered swinger; and the left and right limiting lugs are rightly positioned on the top inside of the rotating arc of the driving lever, as a result, the gear set is enabled by the control of the circuit board to drive the driving lever to rotate forwardly to push the right limiting lug and to rotate backwardly to push the left limiting lug in turn, so that the flame piece body of the flame piece swinger generates a swing in the central through hole of the light source fixation base.

In the electronic simulation candle provided by the present invention, an upright slot capable of serving as a flame core is further disposed at a near-bottom end of the flame piece body.

In the electronic simulation candle provided by the present invention, a flame core having a better simulation effect may be further formed at the near-bottom end of the flame piece body by means of drawing, printing or attaching.

In the electronic simulation candle provided by the present invention, the power driven device may further consist of a chassis with a solenoid coil provided therein; and the bottom of the flame piece swinger is provided with a permanent magnet, as a result, the solenoid coil generates a magnetic field continuously under the control of the circuit board, so that the flame piece swinger with a permanent magnet provided on the bottom can swing, and the flame piece body generates a swing which looks like flame under the coordination of the irradiation light source.

In the electronic simulation candle provided by the present invention, the permanent magnet can be a round flat magnet or an annular magnet.

Additionally, the present invention provides an electronic simulation candle, further comprising a power supply base, a power driven device, a flame piece swinger and a light source fixation base, wherein:

the power supply base is an upright base having an accommodation space therein, which accommodation space can be used for accommodating batteries and then closed via a cover plate on the bottom thereof, a circuit board electrically connected to the power supply base being provided outside the power supply base, a fixed base being disposed in the top center of the power supply base;

the power driven device consists of a chassis which is provided with a gear set therein and sheathed on the fixed base, the gear set being electrically connected to the circuit board, an output rotating shaft of the gear set extending upward out from the top wall of the chassis and sheathed with a turntable, a fixed column having a fixed slot being provided on the outside of the upper surface of the turntable, left and right limiting stand columns being provided on the chassis outside the turntable, a positioning driving lever extending outward and rightly positioned between the left and right limiting stand columns being provided on the outer edge of the turntable;

the upper half of the flame piece swinger is a flame piece body having a concave surface, a hollow tapered swinger expanding gradually from up to down being integrally disposed below the flame piece body, an opening being provided on the bottom or side wall of the hollow tapered swinger; in addition, an upper half provided on the fixed column on the turntable is able to be inserted upward into the hollow tapered swinger, with its top supporting against the inside top of the hollow tapered swinger; and the light source fixation base is fixed above the power driven device, in addition to a central through hole, the light source fixation base being provided with a light source base obliquely passing through the central through hole upward and fixedly provided with an irradiation light source, the irradiation light source facing the concave surface of the flame piece body in addition to being electrically connected to the circuit board, the gear set being enabled by the control of the circuit board to drive the positioning driving lever to rotate forwardly to push the right limiting stand column and to rotate backwardly to push the left limiting stand column in turn, so that the turntable is allowed to rotate forwardly and backwardly and the flame piece body of the flame piece swinger generates a swing which looks like flame under the coordination of the irradiation light source.

In the electronic simulation candle provided by the present invention, a shell in a form of candle can be further sheathed on the outermost side of the electronic simulation candle, the top of the shell being formed like a concave arc, a hole from which the flame piece body extends outward being provided in the center of the shell.

Compared with the prior art, the present invention has the following advantages and beneficial effects:

1. the flame piece swinger disclosed by the present invention, by the support of the top of the support rod against the top of the inner space accommodating the hollow tapered swinger, is allowed to wobble or swing irregularly, thus to drive the flame piece body above the flame piece swinger to wobble or swing irregularly in multiple directions, so as to create a more realistic effect of flame flickering;

2. as the flame piece of an existing electronic simulation candle is movably supported or hung onto an enclosure via a wire or support rod, the wire or support rod may be seen at a close look of the flame piece, as a result, the electronic candle is not so realistic with low degree of simulation; instead, the flame piece body provided by the present invention is directly sheathed on the top of the support rod to support against the top of the inner space of the hollow tapered swinger below the flame piece body, and only the flame piece body may be seen at a close look, so that the degree of simulation of the electronic simulation candle is higher; and 3. the flame piece body of the flame piece swinger provided by the present invention is further provided with an upright slot, so the upright slot will have black-hole effect when the swing of the flame piece body provided by the present invention is in coordination with the irradiation light source, thereby allowing the flame piece body to have a better simulation effect of the flame core.

DETAILED DESCRIPTION OF THE PREFERRED EMBODIMENTS

The present invention will be described as below in details with reference to drawings by specific embodiments.

Figure 1:
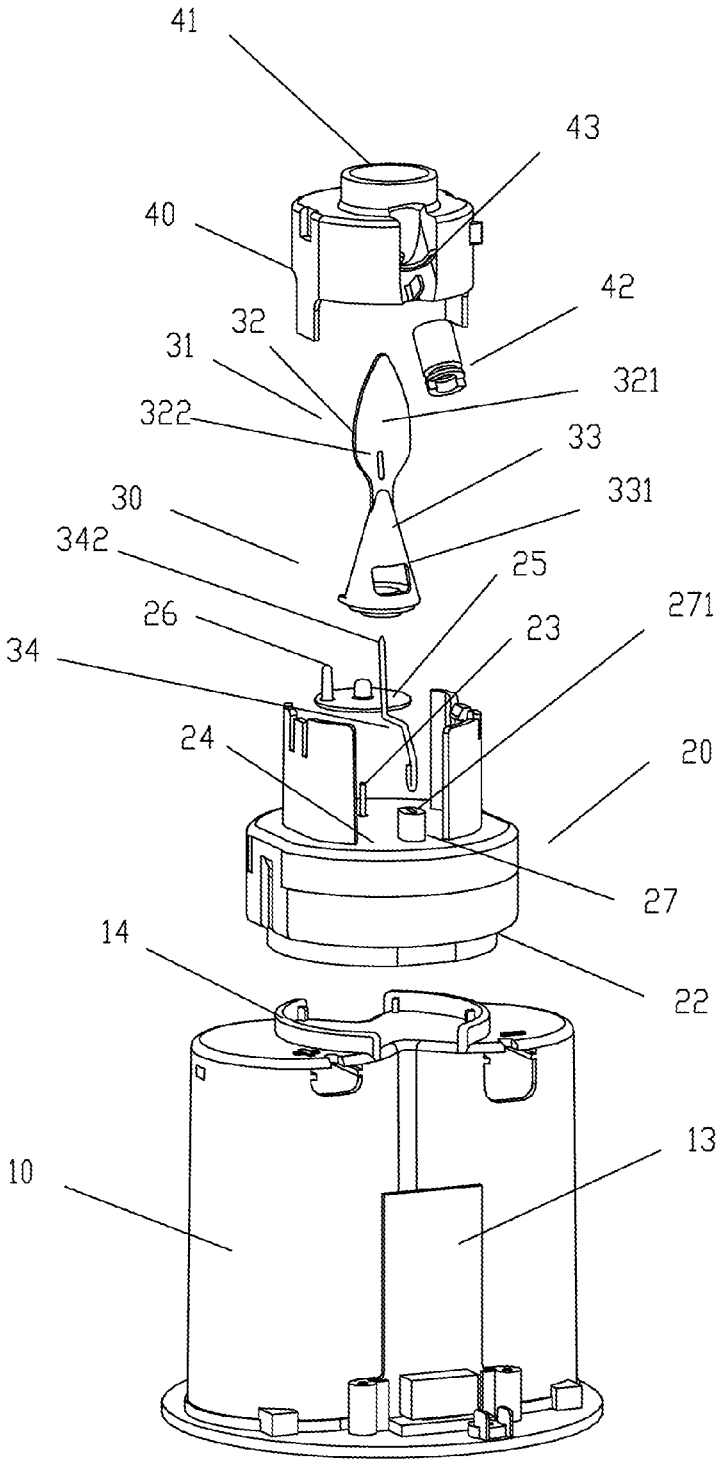
FIG. 1 is an exploded view of a stereoscopic structure of a first embodiment of an electronic simulation candle according to the present invention.
Figure 2:
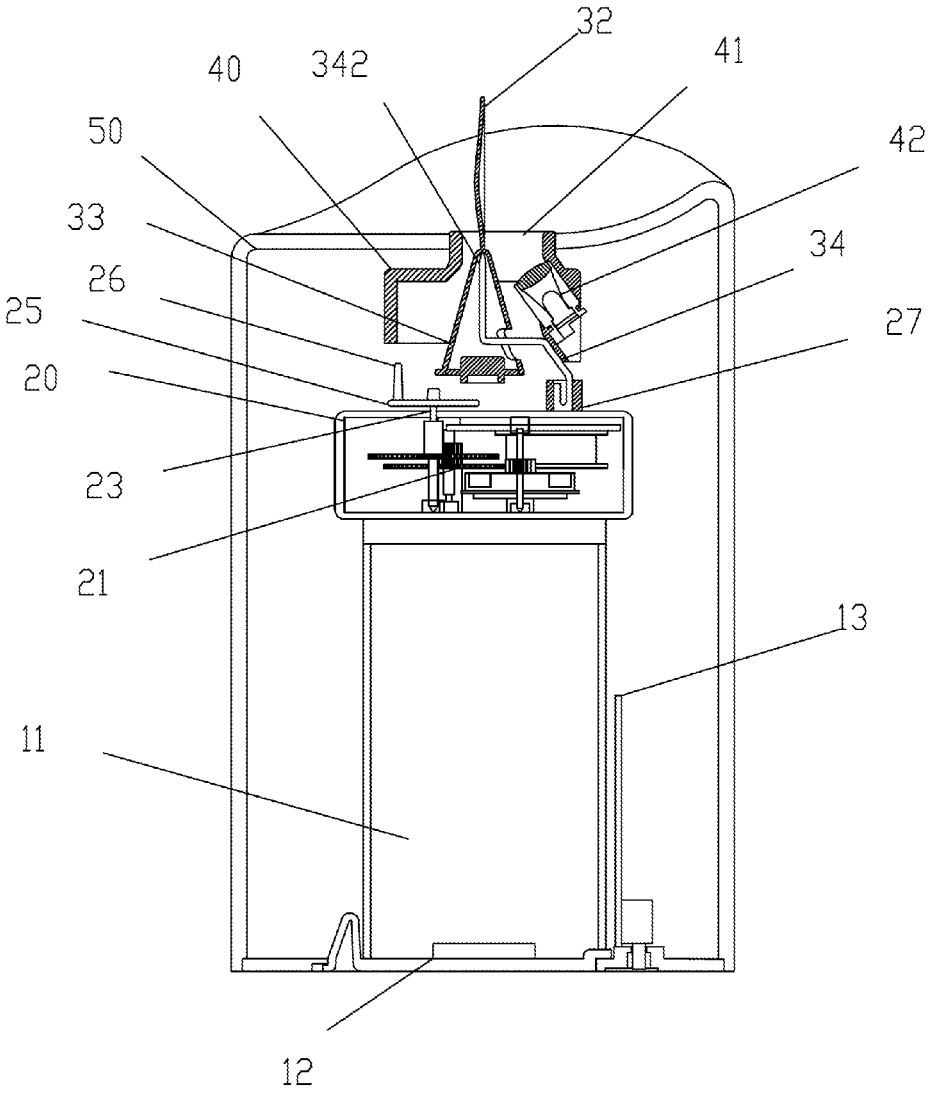
FIG. 2 is a sectional structure diagram of the first embodiment of the electronic simulation candle according to the present invention, a shell in a form of candle being sheathed on the outermost side of the electronic simulation candle.
Figure 3:
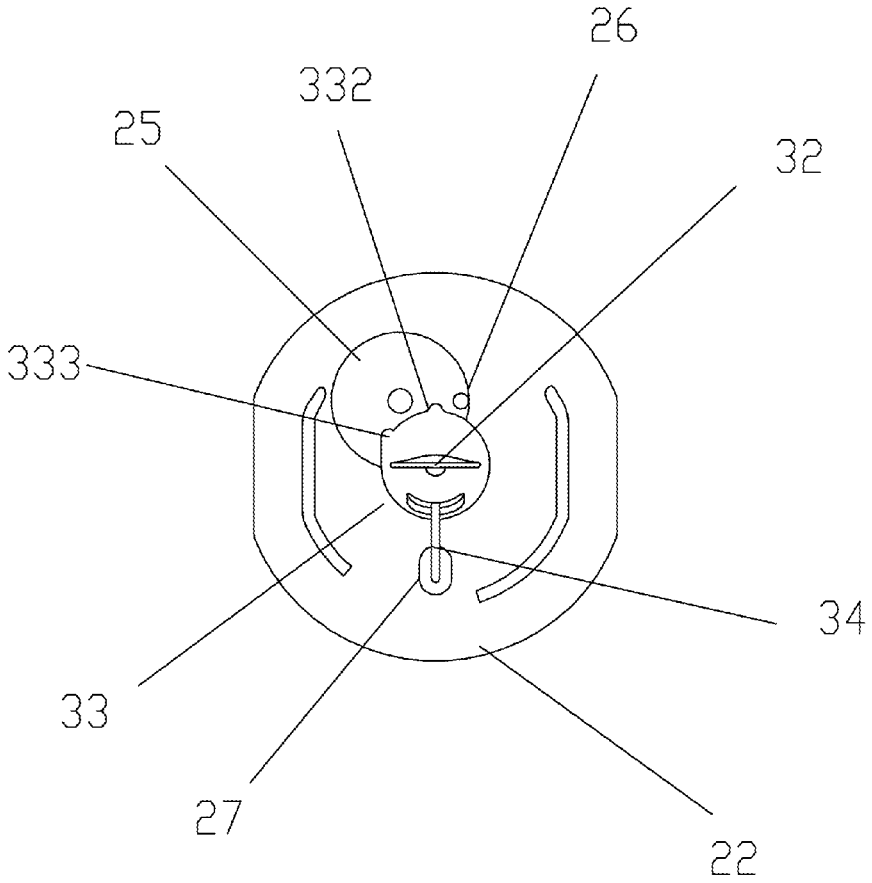
FIG. 3 is a schematic diagram of an actuation structure between a flame piece swinger and a turntable according to the first embodiment of the present invention.

FIG. 1 to FIG. 3 show a first embodiment of the present invention. The disclosed electronic simulation candle mainly comprises a power supply base 10, a power driven device 20, a flame piece swinger 30 and a light source fixation base 40. The power driven device 20 is electrically connected to the power supply base 10 and disposed above the power supply base 10. The light source fixation base 40 is disposed above the power driven device 20. The flame piece swinger 30 is disposed between the power driven device 20 and the light source fixation base 40. The power supply base 10 is an upright base having an accommodation space 11 therein, which accommodation space 11 can be used for accommodating batteries (not shown) and then closed via a cover plate 12 on the bottom thereof. A circuit board 13 electrically connected to the power supply base 10 is provided outside the power supply base 10. A fixed base 14 is disposed in the top center of the power supply 10.

The power driven device 20 consists of a chassis 22 which is provided with a gear set 21 therein and sheathed on the fixed base 14. An output rotating shaft 23 of the gear set 21 extends upward out from the top wall of the chassis 22 and sheathed with a turntable 25. A driving lever 26 protruded upward is provided on the outside of the upper surface of the turntable 25. In addition, a fixed column 27 having a fixed slot 271 is provided on the upper surface of the chassis 22.

The upper half 31 of the flame piece swinger 30 is a flame piece body 32 having a concave surface 321. A hollow tapered swinger 33 expanding gradually from up to down is integrally disposed below the flame piece body 32. On the side wall of the hollow tapered swinger 33, provided is an opening 331, and provided also is a support rod 34 capable of being inserted into the fixed slot 271. Of course, the support rod and the fixed column may form an integrated structure. The support rod 34 is a slender rod structure having an upper half bent towards the center of the power driven device 20 first and then extending upward. The upper half 341 of the support rod 34 is able to be inserted upward into the hollow tapered swinger 33, with its top 342 supporting against the inside top of the hollow tapered swinger 33. Left and right limiting lugs 332 and 333 are provided on an outside bottom edge of the hollow tapered swinger 33, respectively. The left and right limiting lugs 332 and 333 are rightly positioned on the top inside of the rotating arc of the driving lever 26.

Certainly, the opening may be also provided on the bottom of the hollow tapered swinger. When the opening is provided on the bottom of the hollow tapered swinger, the support rod is an upright elongated rod (not shown).

The light source fixation base 40 is fixed above the power driven device 20. In addition to a central through hole 41, the light source fixation base 40, on a side thereof, is provided with a light source base 43 obliquely passing through the central through hole 41 upward and fixedly provided with an irradiation light source 42. The irradiation light source 42 faces the concave surface 321 of the flame piece body 32 in addition to being electrically connected to the circuit board 13.

When the gear set 21 is enabled by the control of the circuit board 13 to drive the driving lever 26 to rotate forwardly to push the right limiting lug 333, the flame piece swinger 30 may swing by using the top 342 of the support rod 34 as a fulcrum (as shown in FIG. 2). In this case, the turntable 25 will rotate backwardly due to the push resistance to further push the left limiting lug 332. Similarly, the flame piece swinger 30 may swing backwardly by using the top 342 of the support rod 34 as a fulcrum. The flame piece body 32 of the flame piece swinger 30 may swing in the central through hole 41 of the light source fixation base 40. In addition, as the irradiation light source 42 faces the concave surface 321 of the flame piece body 32, a simulation effect of combustion flame will be achieved through the swing of the flame piece body 32 in coordination with the irradiation light source 42.

In addition, an upright slot 322 may be further disposed at a near-bottom end of the flame piece body 32. When the flame piece body 32 swings and thus forms a simulation effect of combustion flame, the upright slot 322 may further form a shape of a flame core, so that the combustion flame formed in the present invention has a better simulation effect.

Certainly, a flame core (not shown) having a better simulation effect may be further formed at the near-bottom end of the flame piece body by means of drawing, printing or attaching.

Figure 4:
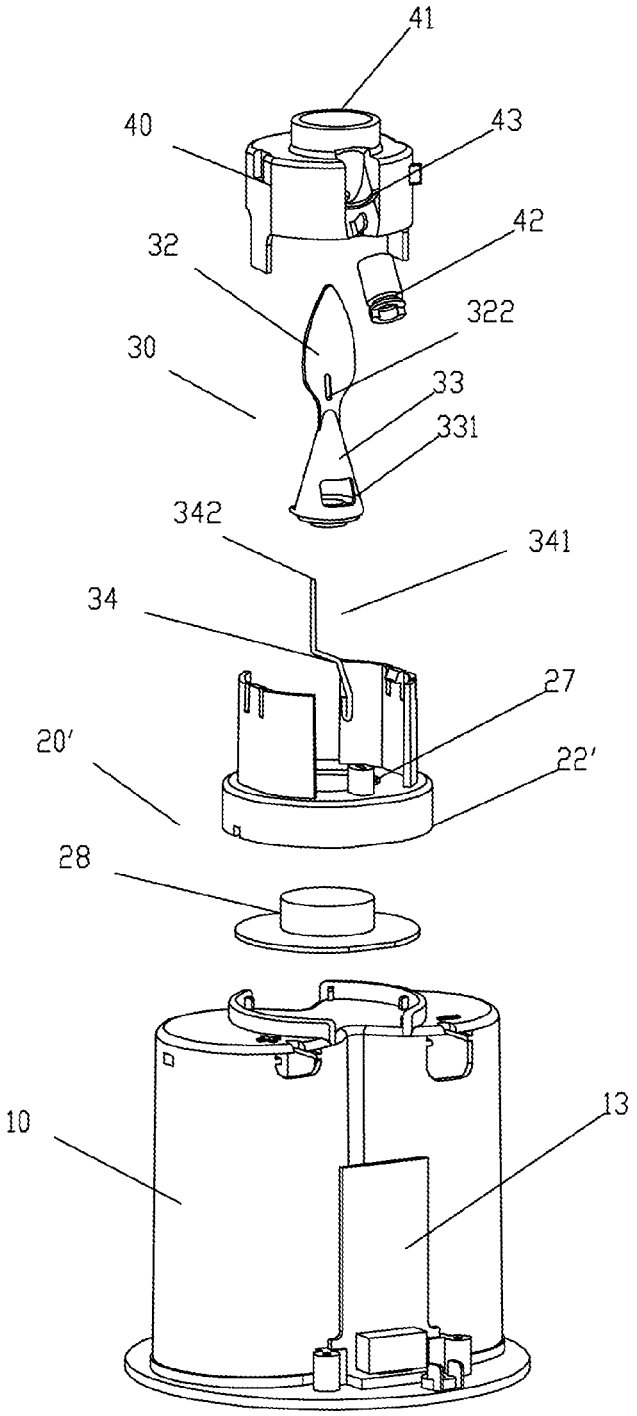
FIG. 4 is an exploded view of a stereoscopic structure of a second embodiment of the electronic simulation candle according to the present invention.
Figure 5:
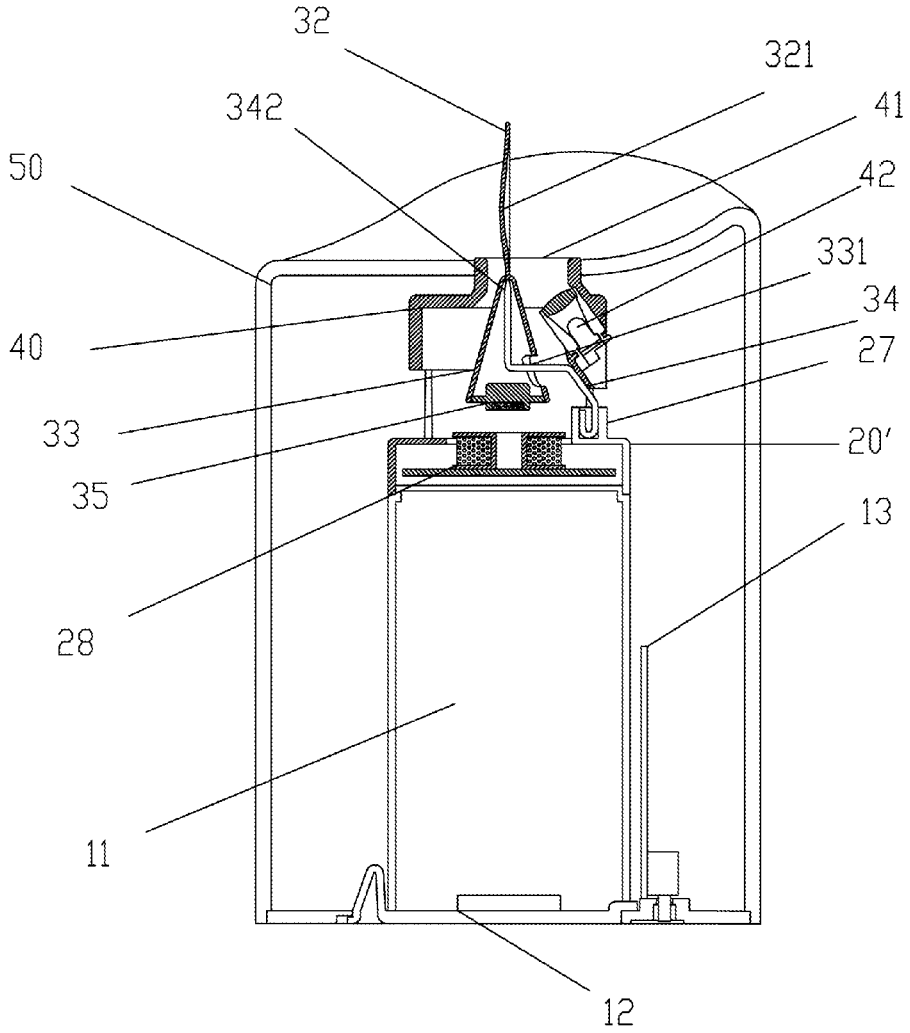
FIG. 5 is a sectional structure diagram of the second embodiment of the electronic simulation candle according to the present invention, a shell in a form of candle being sheathed on the outermost side of the electronic simulation candle.

FIG. 4 and FIG. 5 show a second embodiment of the present invention. The structure of the electronic simulation candle disclosed by this embodiment is roughly the same as that of the first embodiment. However, the difference is that the power driven device 20' consists of a chassis 22' with a solenoid coil 28 provided therein; and that the bottom of the flame piece swinger 30 is provided with a permanent magnet 35, as a result, the solenoid coil 28 generates a magnetic field continuously under the control of the circuit board 13, so that the flame piece swinger 30 with a permanent magnet 35 provided on the bottom may generate a swing (not shown) by using the top 342 of the support rod 34 as a fulcrum, and the flame piece body 32 generates a swing which looks like flame under the coordination of the irradiation light source 42. The permanent magnet may be a round flat magnet or an annular magnet.

Figure 6:
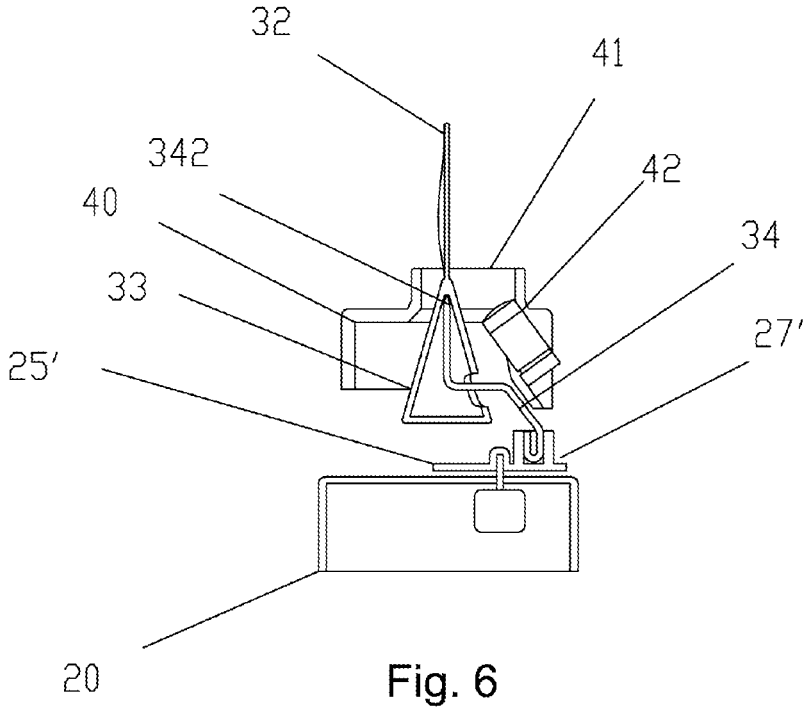
FIG. 6 is a partially sectional structure diagram of a third embodiment of the electronic simulation candle according to the present invention.
Figure 7:
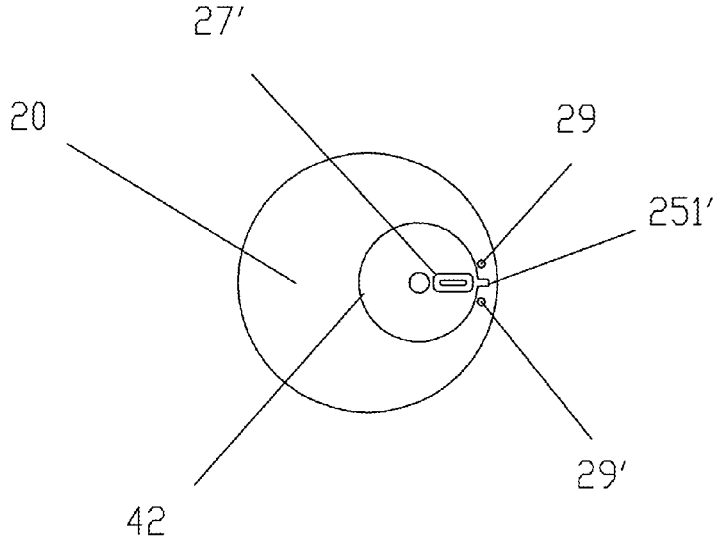
FIG. 7 is a schematic diagram of an actuation structure between a flame piece swinger and a turntable according to the third embodiment of the present invention.

In addition, FIG. 6 shows a third embodiment of the present invention. A modification is that the fixed column 27' for inserting the support rod 34 is provided on the outer side of the upper surface of the turntable 25'. In addition, left and right limiting stand columns 29 and 29' are provided on the chassis 22' outside the turntable 25'. A positioning driving lever 251' (as shown in FIG. 7) extending outward and rightly positioned between the left and right limiting stand columns 29 and 29' is provided on the outer edge of the turntable 25'. The gear set 21 is enabled by the control of the circuit board 13 to drive the positioning driving lever 251' to rotate forwardly to push the right limiting stand column 29' and to rotate backwardly to push the left limiting stand column 29. In such an order, the turntable 25' continuously rotates forwardly and backwardly, so that the flame piece swinger 30 may swing back and forth around the top 342 of the support rod 34, and the flame piece body 32 generates a swing which looks like flame under the coordination of the irradiation light source 42.

Figure 8:
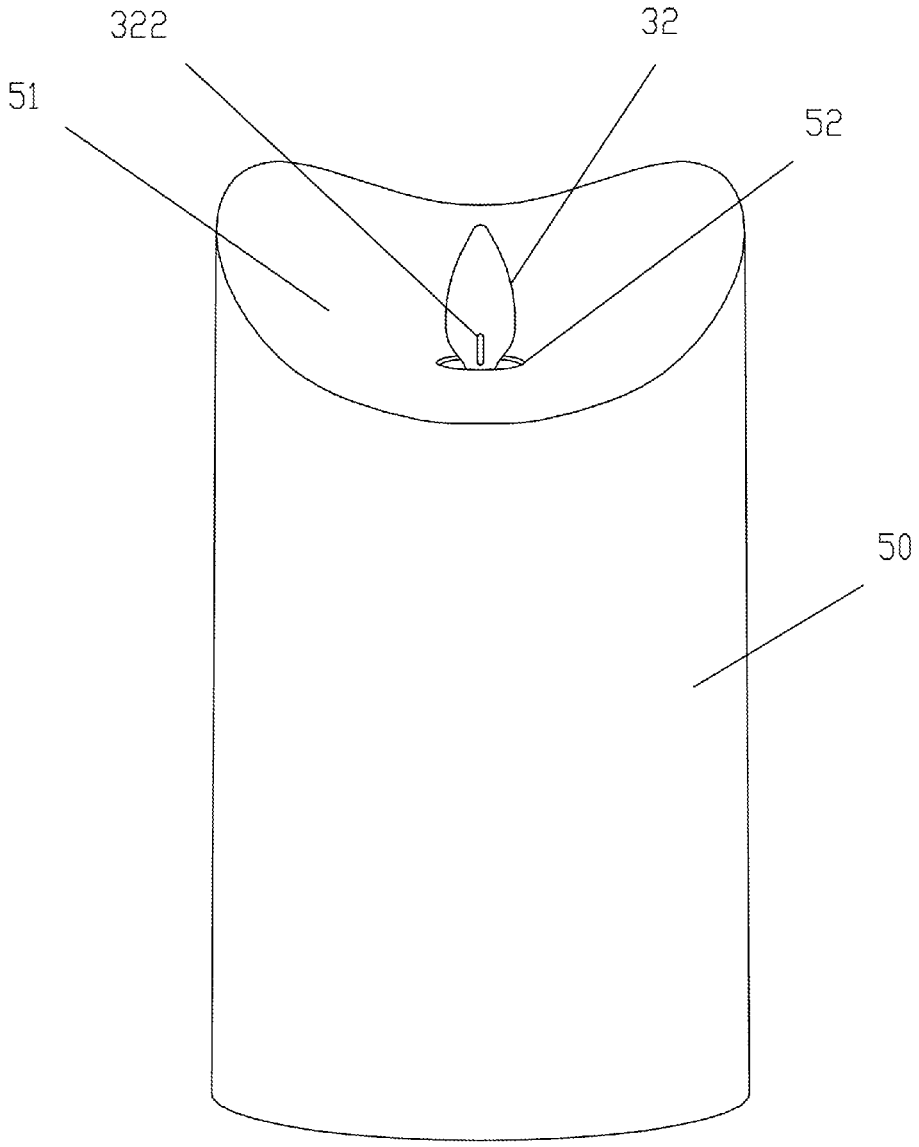
FIG. 8 is a stereoscopic structure diagram of the electronic simulation candle according to the present invention, with a shell in a form of candle already sheathed on the outermost side of the electronic simulation candle.

In addition, as shown in FIG. 8, in the electronic simulation candle disclosed by the present invention, a shell 50 in a form of candle may be further sheathed on the outermost side of the electronic simulation candle. The top of the shell 50 is formed like a concave arc 51. A hole 52 from which the flame piece body 32 extends outward is provided in the center of the shell. By the sheathed arrangement of the shell 50, the electronic simulation candle disclosed by the present invention looks more like a candle.

As the flame piece swinger provided by the present invention is supported against the inside top of the hollow tapered swinger via the top of the support rod, the defect in the known technologies, that the wire by which the flame piece is pivoted will be seen when the flame piece swinger swings, may be avoided completely; in addition, as the flame piece body of the flame piece swinger is further provided with an upright slot, the present invention may form a better simulation effect of the flame core.

The foregoing embodiments are just preferred embodiments of the present invention, and are not intended to limit the implementation of the present invention. Any other changes, modifications, replacements, combinations, simplifications and so on without departing from the spirit and principle of the present invention shall be regarded as equivalent substitutions and fall into the protection scope of the present invention.

What is claimed is:

1. An electronic simulation candle, comprising a power supply base, a power driven device, a flame piece swinger and a light source fixation base, the power driven device being electrically connected to the power supply base and disposed above the power supply base, the light source fixation base being disposed above the power driven device, the flame piece swinger being disposed between the power driven device and the light source fixation base, in addition, an upper half of the flame piece swinger extending upward out from a central through hole provided on the light source fixation base, characterized in that the upper half of the flame piece swinger is a flame piece body having a concave surface, a hollow tapered swinger expanding gradually from up to down is integrally disposed below the flame piece body; and an opening provided on a side wall of the hollow tapered swinger; in addition, a support rod extending upward being inserted into the power driven device, and having an upper half bent towards a center of the power driven device first and then extending upwardly, and the upper half of the support rod is inserted upward into the hollow tapered swinger, from the opening on the side wall, with its top supporting against an inside top of the hollow tapered swinger.

2. The electronic simulation candle according to claim 1, wherein an upright slot capable of serving as a flame core is further disposed at a near-bottom end of the flame piece body.

3. The electronic simulation candle according to claim 1, wherein a flame core having a better simulation effect can be further formed at the near-bottom end of the flame piece body by means of drawing, printing or attaching.

4. The electronic simulation candle according to claim 1, wherein the power supply base is an upright base having an accommodation space therein, which accommodation space can be used for accommodating batteries and then closed via a cover plate on the bottom thereof, a circuit board electrically connected to the power supply base being provided outside the power supply base, a fixed base being disposed in the top center of the power supply base.

5. The electronic simulation candle according to claim 1, wherein the power driven device comprises a chassis which is provided with a gear set therein and sheathed on the fixed base, an output rotating shaft of the gear set extending upward out from the top wall of the chassis and sheathed with a turntable, a driving lever protruded upward being provided on the outside of the upper surface of the turntable, a fixed column having a fixed slot being provided on the upper surface of the chassis, the fixed slot being provided for insertion and fixation of the bottom end of the support rod.

6. The electronic simulation candle according to claim 5, wherein left and right limiting lugs are provided on an outside bottom edge of the hollow tapered swinger; and the left and right limiting lugs are rightly positioned on the top inside of the rotating arc of the driving lever, as a result, the gear set is enabled by the control of the circuit board to drive the driving lever to rotate forwardly to push the right limiting lug and to rotate backwardly to push the left limiting lug in turn, so that the flame piece body of the flame piece swinger generates a swing in the central through hole of the light source fixation base.

7. The electronic simulation candle according to claim 6, wherein an upright slot capable of serving as a flame core is further disposed at a near-bottom end of the flame piece body.

8. The electronic simulation candle according to claim 6, wherein a flame core having a better simulation effect may be further formed at the near-bottom end of the flame piece body by means of drawing, printing or attaching.

9. The electronic simulation candle according to claim 5, wherein the support rod and the fixed column form an integrated structure.

10. The electronic simulation candle according to claim 1, wherein the light source fixation base is fixed above the power driven device, a light source base obliquely passing through the central through hole upward and being fixedly provided with an irradiation light source being disposed on a side of the light source fixation base, the irradiation light source facing the concave surface of the flame piece body in addition to being electrically connected to the circuit board.

11. The electronic simulation candle according to claim 1, wherein the power driven device comprises a chassis with a solenoid coil provided therein; and the bottom of the flame piece swinger is provided with a permanent magnet, as a result, the solenoid coil generates a magnetic field continuously under the control of the circuit board, so that the flame piece swinger with a permanent magnet provided on the bottom can swing, and the flame piece body generates a swing which looks like flame under the coordination of the irradiation light source.

12. The electronic simulation candle according to claim 11, wherein the permanent magnet can be a round flat magnet or an annular magnet.

13. The electronic simulation candle according to claim 11, wherein an upright slot capable of serving as a flame core is further disposed at a near-bottom end of the flame piece body.

14. The electronic simulation candle according to claim 11, wherein a flame core having a better simulation effect may be further formed at the near-bottom end of the flame piece body by means of drawing, printing or attaching.

15. The electronic simulation candle according to claim 1, wherein a shell in a form of candle can be further sheathed on the outermost side of the electronic simulation candle, the top of the shell being formed like a concave arc, a hole from which the flame piece body extends outward being provided in the center of the shell.

16. An electronic simulation candle, comprising a power supply base, a power driven device, a flame piece swinger and a light source fixation base, wherein, the power supply base is an upright base having an accommodation space therein, which accommodation space can be used for accommodating batteries and then closed via a cover plate on the bottom thereof, a circuit board electrically connected to the power supply base being provided outside the power supply base, a fixed base being disposed in the top center of the power supply base;

the power driven device comprises a chassis which is provided with a gear set therein and sheathed on the fixed base, the gear set being electrically connected to the circuit board, an output rotating shaft of the gear set extending upward out from a top wall of the chassis and sheathed with a turntable, a fixed column having a fixed slot provided on a outside of an upper surface of the turntable, left and right limiting stand columns provided on the chassis outside the turntable, a positioning driving lever extending outward and rightly positioned between the left and right limiting stand columns being provided on the outer edge of the turntable;

an upper half of the flame piece swinger is a flame piece body having a concave surface, a hollow tapered swinger expanding gradually from up to down being integrally disposed below the flame piece body, an opening being provided on a side wall of the hollow tapered swinger; in addition, an upper half of a support rod attached provided on the fixed column on the turntable is inserted upward into the hollow tapered swinger, with its top supporting against the inside top of the hollow tapered swinger; and the light source fixation base is fixed above the power driven device, in addition to a central through hole, the light source fixation base being provided with a light source base obliquely passing through the central through hole upward and fixedly provided with an irradiation light source, the irradiation light source facing the concave surface of the flame piece body in addition to being electrically connected to the circuit board, the gear set being enabled by the control of the circuit board to drive the positioning driving lever to rotate forwardly to push the right limiting stand column and to rotate backwardly to push the left limiting stand column in turn, so that the turntable is allowed to rotate forwardly and backwardly and the flame piece body of the flame piece swinger generates a swing which looks like flame under the coordination of the irradiation light source.

17. The electronic simulation candle according to claim 16, wherein an upright slot capable of serving as a flame core is further disposed at a near-bottom end of the flame piece body.

18. The electronic simulation candle according to claim 16, wherein a flame core having a better simulation effect may be further formed at the near-bottom end of the flame piece body by means of drawing, printing or attaching.

* * * * *